US005134752A

United States Patent [19]

Shipman

[11] Patent Number: 5,134,752

[45] Date of Patent: Aug. 4, 1992

[54] VACUUM CLEANER

[76] Inventor: Frank M. Shipman, P.O. Box 7402, Louisville, Ky. 40207

[21] Appl. No.: 548,118

[22] Filed: Jul. 5, 1990

[51] Int. Cl.[5] ..... A47L 5/30

[52] U.S. Cl. ..... 15/412; 15/351; 15/422.2; 15/DIG. 1

[58] Field of Search ..... 15/412, 422.2

[56] References Cited

U.S. PATENT DOCUMENTS 1,611,786 12/1926 Serva ..... 15/422.2 X
2,019,895 11/1935 Dow ..... 15/350 X
2,187,104 1/1940 Leathers ..... 15/350 X
2,218,035 10/1940 Benson ..... 15/422.2 X
2,468,128 4/1949 Sparklin ..... 15/412 X
3,848,290 11/1974 Bates ..... 15/422.2
3,872,539 3/1975 Doyel ..... 15/412 X
4,195,969 4/1980 Whitney ..... 15/412 X
4,225,999 10/1980 Martinec et al. ..... 15/422.2
4,793,054 12/1988 Abbratozzato et al. ..... 29/596

*Primary Examiner*—Chris K. Moore
*Attorney, Agent, or Firm*—Theresa Fritz Camoriano

[57] ABSTRACT

A vacuum cleaner includes two blowers connected in series, one upstream of the filter and the other downstream.

9 Claims, 4 Drawing Sheets

VACUUM CLEANER

BACKGROUND OF THE INVENTION

The present invention relates to vacuum cleaners, and, particular, to a vacuum cleaner having two blowers.

In the past, upright vacuum cleaners for cleaning carpets have generally had a single blower near the air inlet, which pulled air and dirt into the vacuum cleaner and pushed the air through a vacuum cleaner bag, which served as an air filter. The dirt was left in the bag, and the air left the vacuum cleaner through some sort of outlet, such as the pores in a cloth enclosure bag. Canister-type vacuums generally have a one or two stage blower pulling air through a filter.

Those types of vacuum cleaners were not very energy efficient, but they worked well, as long as they were operated from the household electrical power. However, when people attempted to operate a typical upright vacuum cleaner from a battery, it failed to produce enough air flow for proper suction, and it failed to pick up the dirt in the carpets. Both in the interest of saving energy and in the interest of taking advantage of the convenience of battery operation, the problem to be solved by the present invention was how to make a vacuum cleaner that worked as well as the prior art vacuum cleaners without using as much power.

SUMMARY OF THE INVENTION

The purpose of the present invention is to overcome the problems of the prior art by making a vacuum cleaner which has sufficient air flow to create a suction to successfully clean carpets, while using substantially less power than prior art vacuum cleaners.

Another object of the present invention is to make a vacuum cleaner that operates effectively and efficiently enough that use of a battery source of power becomes practical.

DESCRIPTION OF THE PREFERRED EMBODIMENT

Figure 1:
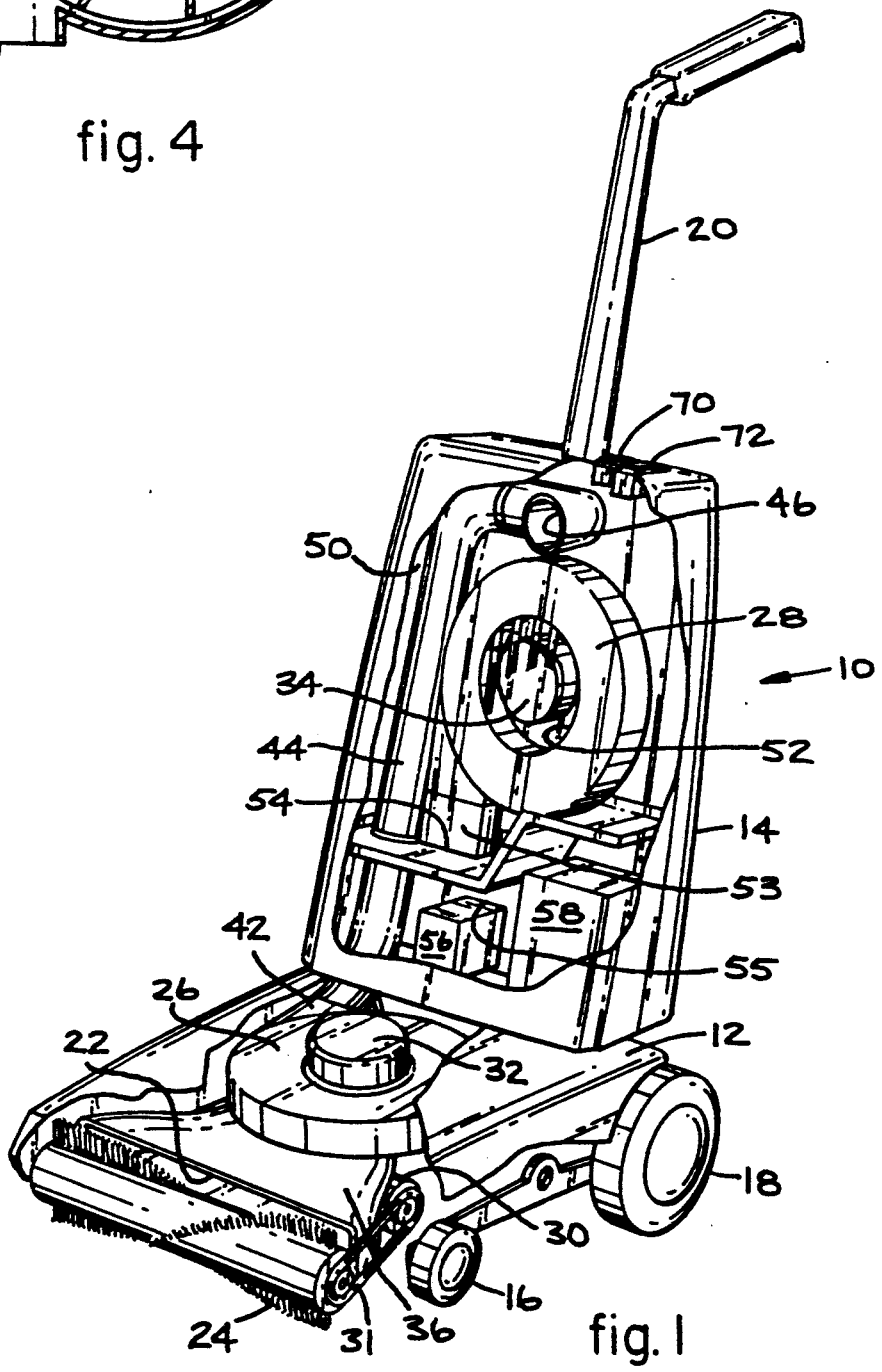
FIG. 1 is a broken-away schematic perspective view of a first embodiment of a vacuum cleaner made in accordance with the present invention, with the vacuum cleaner bag removed.
Figure 2:
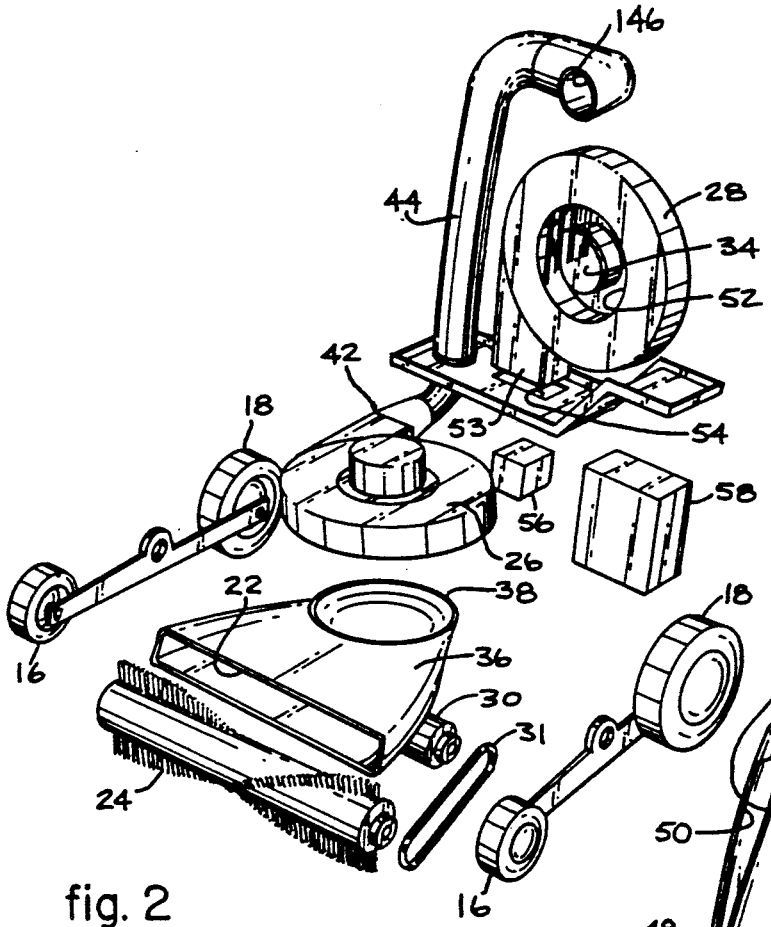
FIG. 2 is an exploded perspective view of the vacuum cleaner of FIG. 1, with the housing removed.
Figure 3:
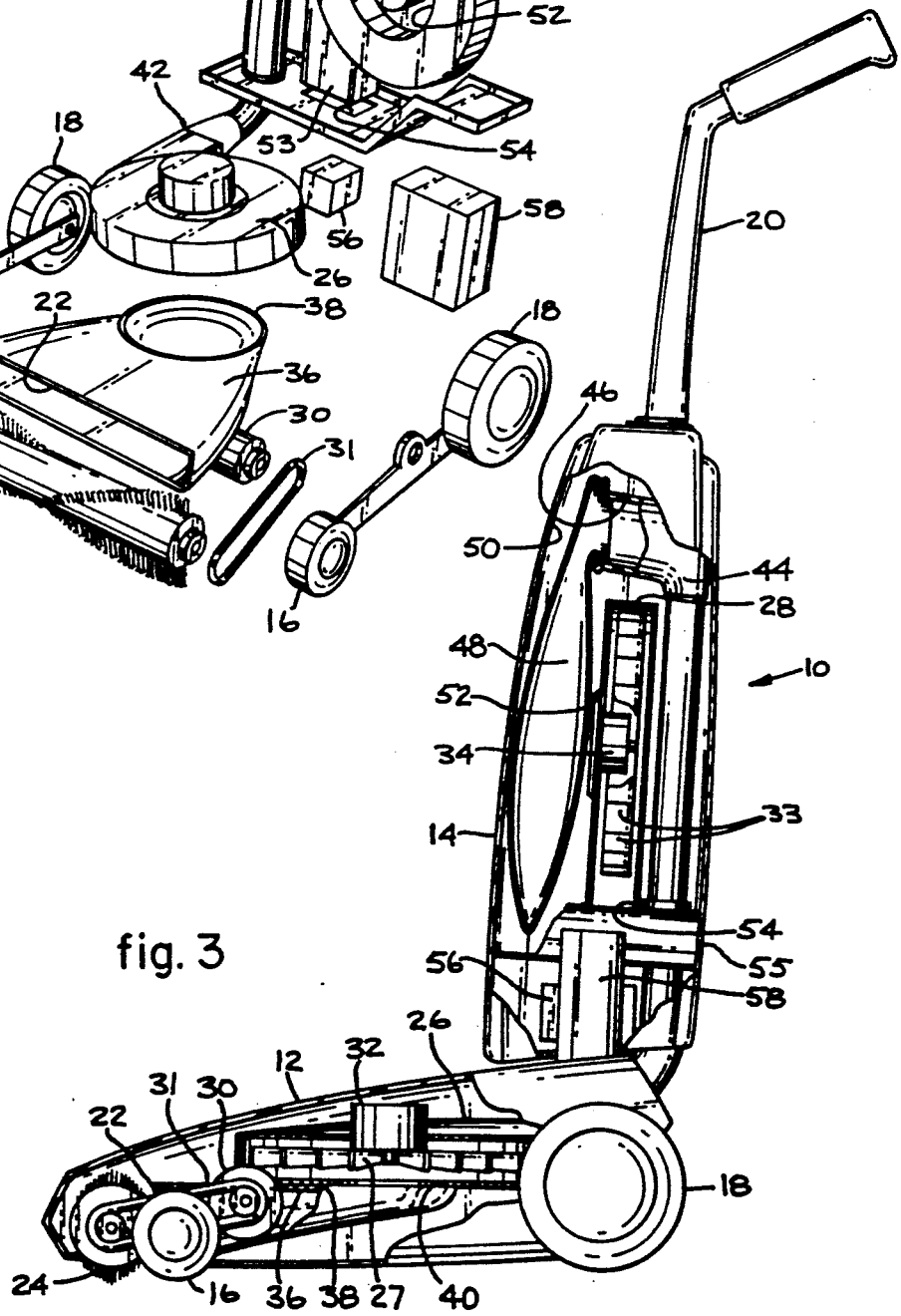
FIG. 3 is a side view partially in section of the vacuum cleaner of FIG. 1, with the vacuum cleaner bag installed.

Two embodiments of the present invention will now be described. It will be obvious that many other embodiments are possible, and many modifications could be made to these embodiments without departing from the scope of the present invention. As shown in FIGS. 1-3, the vacuum cleaner 10 of the present invention is an upright vacuum cleaner, having a base portion 12, and an upright portion 14. The base portion 12 has adjustable-height front wheels 16 and fixed height rear wheels 18 for rolling the vacuum cleaner along the floor to be cleaned.

The upright portion 14 and the base portion 12 are pivotably connected together by means not shown but which are well-known in the art. A handle 20 projects upward from the upright portion 14 so the person using the vacuum cleaner 10 can grasp the handle 20 to push and pull the vacuum cleaner 10 around the area to be vacuumed. The base portion 12 has an air inlet 22, into which air and dirt enter. There preferably will also be a beater bar (or brush) 24, which beats the carpet and helps the dirt become free of the carpet so that it can be picked up into the air inlet 22. The beater bar 24 is driven by a small permanent magnet motor 30 through a belt 31.

The embodiment of the present invention shown in FIGS. 1-3 provides a first blower 26 in the base portion 12 and a second blower 28 in the upright portion 14. The two blowers 26, 28 are connected in series to create a greater suction than either could create individually. The impellers 27, 29 on the blowers 26, 28 are larger in diameter than most prior at vacuum cleaners (i.e. about 7 inches in diameter as compared with 4 to 5½ inches in the prior art), in order to move large amounts of air at a relatively low number of revolutions per minute. Prior art vacuum cleaners have blower speeds of over nine thousand revolutions per minute in order to achieve the necessary air flow, while, in order to obtain greater efficiency, the blowers of the present invention operate in the range of three thousand to six thousand revolutions per minute. A single, very large blower operating at a slower speed could probably move enough air, but it would not fit into the housing of a standard-sized vacuum cleaner. As it is, these blowers had to be oriented so that their diameters lie in the direction of the largest dimension of the vacuum cleaner. This is opposite to the orientation of the prior art blowers. The present blowers 26, 28 are driven by permanent magnet motors 32, 34, respectively. Permanent magnet motors are used in order to increase the efficiency of the vacuum cleaner. However, permanent magnet motors lose their efficiency at high speeds. Therefore, large blowers (two connected in series) are needed in order to take advantage of the efficiency of permanent magnet motors at low speeds while still creating enough air flow to pull dirt though the vacuum cleaner 10.

The combination of permanent magnet motors and two large diameter blowers connected in series permits the substantial increase in efficiency of the present invention.

Figure 4:
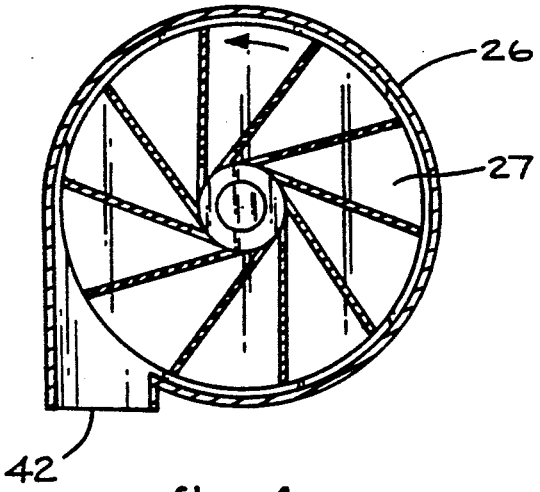
FIG. 4 is a bottom sectional view through the lower blower of FIG. 1.
Figure 8:
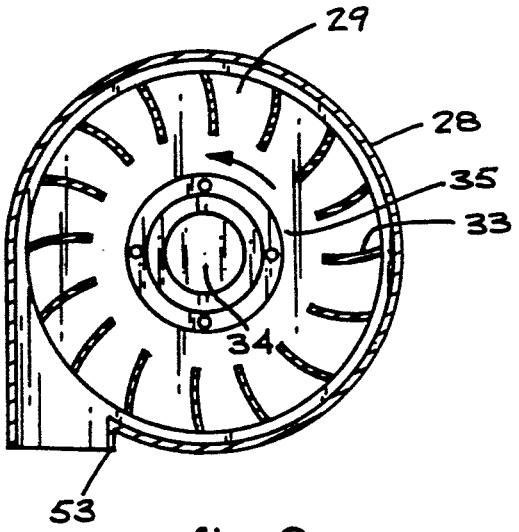
FIG. 8 is a sectional view through the upper blower of FIG. 1.

The vacuum cleaner's air inlet opening 22 is formed by a hood 36 which has a top opening 38 onto which the first blower 26 is mounted. The first permanent magnet motor 32 is mounted on top of the first blower 26. The first blower 26, which is shown in section in FIGS. 3 and 4, has a central inlet opening 40 which fits into the top opening 38 of the hood 36. The impeller 27 of the first blower 26 has a plurality of straight blades which are tilted backward from the impeller's direction of rotation. The reason for using this type of blower 26 is that it moves the dirt along to the vacuum cleaner bag 48 rather than trapping the dirt in the impeller 27. A seal is formed between the housing of the first blower 26 and the hood 36 so that no air leaks into the joint between the two pieces. Unless otherwise stated, this is true of all the connections along the air flow path. The first blower outlet 42 connects to a flexible hose 44, which extends upward to the upright portion 14 of the vacuum cleaner 10. The outlet 46 of the hose 44 connects to the inside of the vacuum cleaner bag 48 as shown in FIG. 3. The vacuum cleaner bag 48 sits in a sealed housing 50, which surrounds the bag 48, and the only way air can leave the housing 50 is through the second blower 28. The second blower 28 has a central opening 52 in front, which lies adjacent to the vacuum cleaner bag 48. The second blower 28 is a squirrel cage type of blower. The cross-section view in FIG. 8 shows the impeller 29 of the second blower 28, including the blades 33 and the back wall 35 of the impeller 29. The back wall of the impeller 29 is closed, so all the air entering the blower 28 must come through the front opening 52. The view in FIG. 8 shows the permanent magnet motor 34 located in the central opening 52. The permanent magnet motor 34 is mounted on the blower housing 28. A squirrel cage blower is more efficient at the lower speed range than the straight-blade blower 26, and it can be used in this location, because it is protected from the dirt by the bag 48, which traps all but the finest particles of dust. The outlet 53 of the second blower 28 extends through a sealed opening 54 in the floor of the sealed chamber 50 and then out of the vacuum cleaner 10 through an outlet 55, with the air flowing over the transformer 56 and past the battery 58 as it exits the vacuum cleaner 10. The entire enclosure which defines the air flow path, including the hood 36, the housing of the blower 26, the flexible hose 44, the sealed housing 50, the housing of the second blower 28, through to the outlet 55, is referred to herein as the plenum. In this embodiment, the plenum is housed in a base portion 12 and an upright portion 14 of the vacuum cleaner.

Thus, as described above, the first blower 26 is located upstream of the bag 48, and the second blower 28 is located downstream of the bag 48, with the two blowers mounted in series so that the first blower 26 is pushing air into the bag 48 and the second blower 28 is pulling air through the bag. The bag 48 serves as a filter, removing dirt from the air stream and collecting the dirt.

Figure 5:
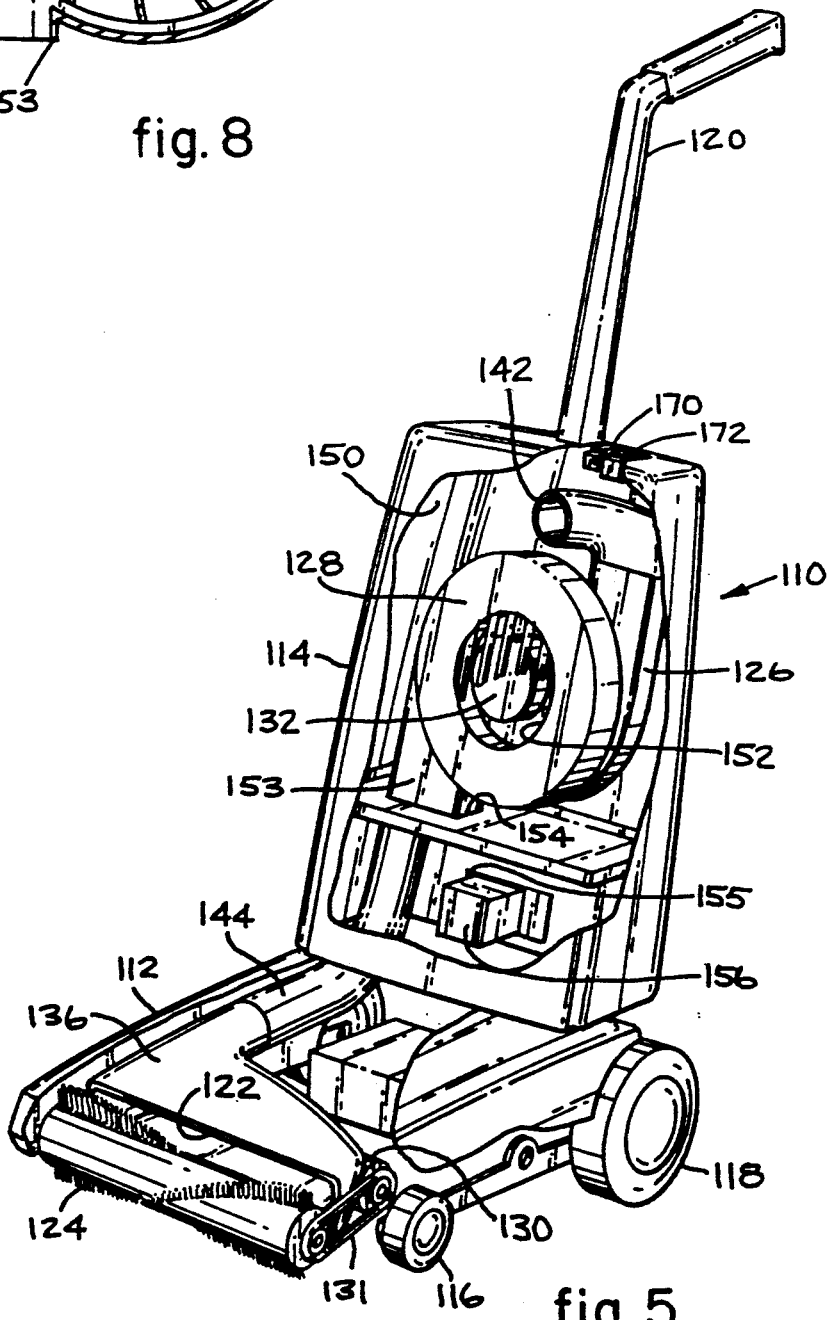
FIG. 5 is a broken-away schematic perspective view of a second embodiment of a vacuum cleaner made in accordance with the present invention, with the vacuum cleaner bag removed.
Figure 6:
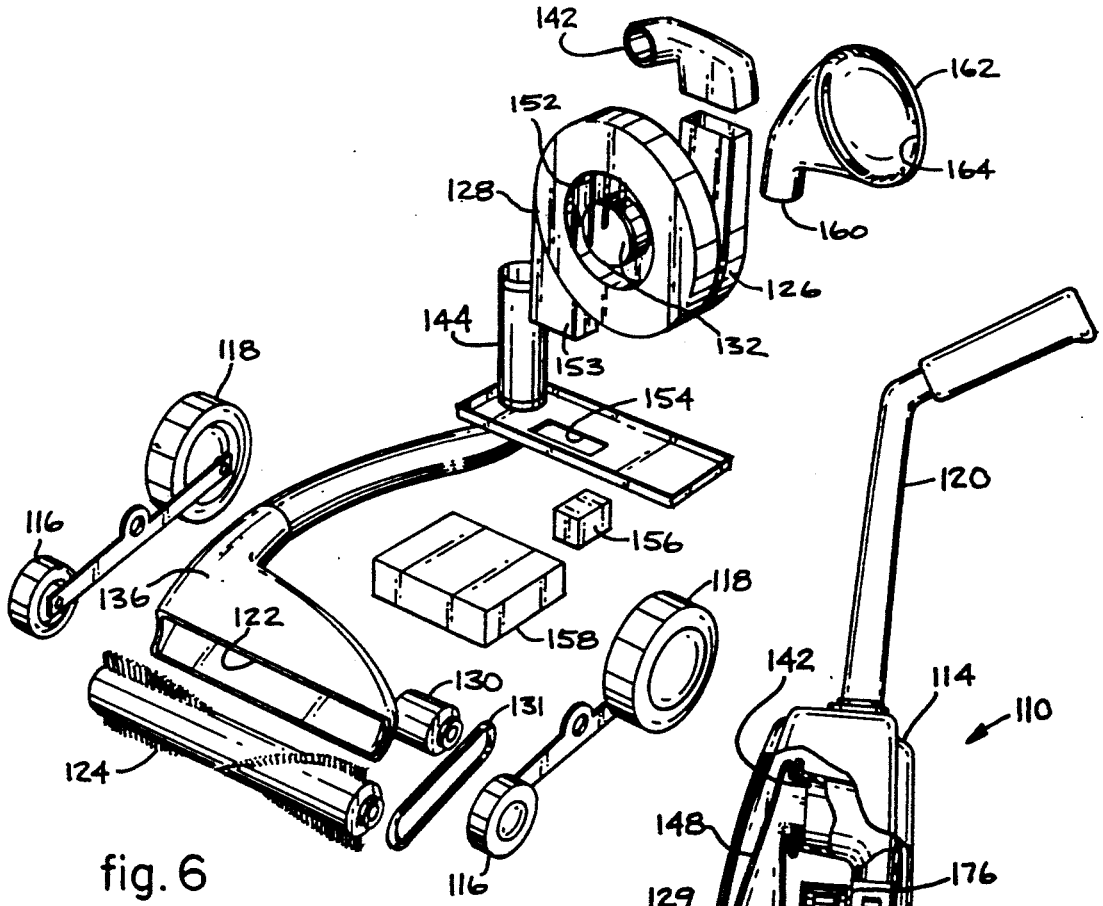
FIG. 6 is an exploded perspective view of the vacuum cleaner of FIG. 5, with the housing removed.
Figure 7:
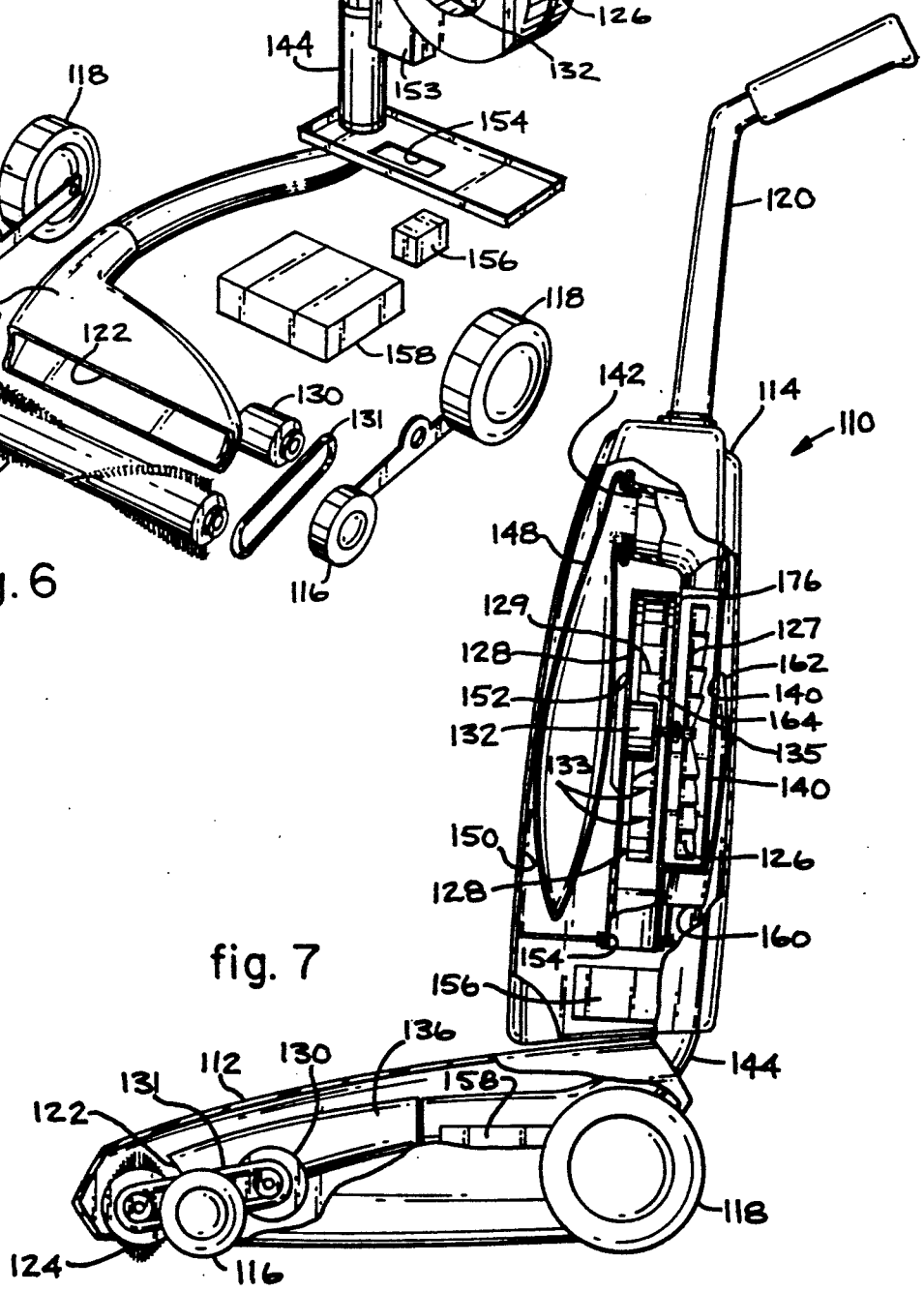
FIG. 7 is a side view partially in section of the vacuum cleaner of FIG. 5, with the vacuum cleaner bag installed.

A second embodiment of the present invention is shown in FIGS. 5–7. When describing this embodiment, numbers will be used which correspond to the similar parts in the first embodiment. FIGS. 5–7 show a vacuum cleaner 110 which is very similar to the vacuum cleaner 10 of the first embodiment, with a few changes. This embodiment has a base 112 and an upright portion 114 and front wheels 116 and rear wheels 118 as in the first embodiment. It has a handle 120 and a beater bar 124 driven by means of a small motor 130 through a belt 131. It has an air inlet 122, which leads to a hose 144. However, unlike the first embodiment, this second embodiment has no blower in the base portion 112. In this embodiment, the first and second blowers 126, 128 are both located in the upright portion 114, and, instead of each blower having its own motor, these two blowers are driven by a single motor 132, located inside the central opening of the squirrel cage blower 128 (the second blower). In this embodiment, the two blowers 126, 128 share a wall 176, which makes this arrangement very compact. The two blowers 126, 128 lie adjacent to each other, with no motor or other element of the vacuum cleaner causing them to be separated from each other. The blowers 126, 128 have the same impellers 127, 129 and the same cross-section as the corresponding blowers 26, 28 which were shown and described in the first embodiment.

In this second embodiment, the first blower 126, which is a straight-blade blower as in the first embodiment, pulls air up through the air inlet 122 and through the hose 144 into the inlet 160 of the hood 162. The outlet of the hood 162 is a circular opening 164, which seals against the first blower 126 and directs air into the inlet 140 of the first blower 126. The outlet 142 of the first blower connects with the vacuum cleaner bag 148, as in the first embodiment. Again, the vacuum cleaner bag 148 is located in a sealed housing 150, from which the only way air can escape is through the second blower 128. As in the first embodiment, the second blower 128 has a central inlet opening 152, which pulls air through the vacuum cleaner bag 148 and blows it out the exit 153, through a sealed opening 154, over the transformer 156, and out an outlet 155, cooling the transformer 156 as it leaves. In this embodiment, the battery 158 is located in the base 112.

Both embodiments of the present invention include an on-off switch 70, 170 and a socket 72, 172 for connecting the vacuum cleaner to household alternating current power. Since other vacuum cleaners have been run by batteries in the prior art, it is thought that the electrical circuitry for running from a battery need not be described in the present case. A person of ordinary skill in the art can use circuitry already known in order to operate the vacuum cleaner of the present invention.

As described above, the present invention provides a vacuum cleaner which operates as effectively as prior art vacuum cleaners while using considerably less energy. This economy of operation also permits the vacuum cleaner of the present invention to operate effectively from battery power, which is more convenient in many cases than operating from household alternating current, which requires that the vacuum cleaner always be connected to an electrical outlet.

It will be obvious to those skilled in the art that modifications may be made to the embodiments described above without departing from the scope of the present invention.

What is claimed is:

1. A vacuum cleaner, comprising:

a housing plenum, defining a vacuum cleaner inlet and a vacuum cleaner outlet;

a first blower, having a first blower inlet and a first blower outlet, wherein the first blower inlet is in communication with the vacuum cleaner air inlet;

a second blower having a second blower inlet and a second blower outlet, wherein the second blower inlet is in communication with the first blower outlet, so that the two blowers are connected in series, and the second blower outlet is in communications with the vacuum cleaner outlet;

an air filter and dirt collection means lying between the first blower outlet and the second blower inlet, such that the first blower pushes air through the filter, and the second blower pulls air through the filter, and further comprising at least one motor located in said plenum for driving at least one of said blowers, said motor being a permanent magnet motor.

2. A vacuum cleaner as recited in claim 1, wherein at least one of said blowers has an impeller with a diameter in the range of six to nine inches.

3. A vacuum cleaner as recited in claim 1, wherein the first and second blowers have axes which are aligned, and wherein said motor drives both the first and second blowers.

4. A vacuum cleaner, comprising:

a plenum, defining a vacuum cleaner inlet and a vacuum cleaner outlet;

first blower, having a first blower inlet and a first blower outlet, wherein the first blower inlet is in communication with the vacuum cleaner air inlet;

a second blower having a second blower inlet and a second blower outlet, wherein the second blower inlet is in communication with the first blower outlet, so that the two blowers are connected in series, and the second blower outlet is in communication with the vacuum cleaner outlet;

an air filter and dirt collecting means lying between the first blower outlet and the second blower inlet, such that the first blower pushes air through the filter, and the second blower pulls air through the filter, and wherein the first and second blowers have axes which are aligned, and further comprising a motor which drives both the first and second blowers, wherein the second blower includes blower blades and defines a central opening inside the blower blades, and the largest outside diameter of said motor is smaller than the diameter of said opening, and the motor is located in that central opening, with the axial length of said motor fitting substantially within said opening so as to provide a compact blower-and-motor combination.

5. A vacuum cleaner, comprising:

a plenum, defining a vacuum cleaner inlet and a vacuum cleaner outlet;

a blower mounted in said plenum, said blower including blower blades and defining a central opening inside the blower blades which serves as the blower inlet; and a motor mounted in the central opening of the blower so as to drive the blower; wherein the largest outside diameter of said motor is smaller than the inside diameter of the central opening, with the axial length of said motor fitting substantially within said opening so as to provide a compact blower-and-motor combination.

6. A vacuum cleaner as recited in claim 4, wherein the first and second blowers abut each other.

7. A vacuum cleaner as recited in claim 1, and further comprising a transformer located inside the plenum, said transformer being located such that air leaving the second blower outlet flows over the transformer.

8. A vacuum cleaner, comprising:

a plenum, defining a vacuum cleaner inlet and a vacuum cleaner outlet;

a first blower, having a first blower inlet and a first blower outlet, wherein the first blower inlet is in communication with the vacuum cleaner air inlet;

a second blower having a second blower inlet and a second blower outlet, wherein the second blower inlet is in communication with the first blower outlet, so that the two blowers are connected in series, and the second blower outlet is in communication with the vacuum cleaner outlet;

an air filter and dirt collection means lying between the first blower outlet and the second blower inlet, such that the first blower pushes air through the filter, and the second blower pulls air through the filter, and further comprising a beater bar mounted on the vacuum cleaner and a permanent magnet motor for driving the beater bar.

9. A vacuum cleaner as recited in claim 4, wherein said vacuum cleaner plenum includes a base portion and an upright portion connected to the base portion, and wherein the first and second blowers are located in said upright portion, with the axes of the first and second blowers extending substantially horizontally when said upright portion is in a vertical position.

* * * * *